US005272484A

United States Patent [19]

Labaar

[11] Patent Number: 5,272,484

[45] Date of Patent: Dec. 21, 1993

[54] RECIRCULATING DELAY LINE TRUE TIME DELAY PHASED ARRAY ANTENNA SYSTEM FOR PULSED SIGNALS

[75] Inventor: Frederik Labaar, Long Beach, Calif.

[73] Assignee: TRW Inc., Redondo Beach, Calif.

[21] Appl. No.: 966,913

[22] Filed: Oct. 27, 1992

[51] Int. Cl.[5] ..... H01Q 3/22

[52] U.S. Cl. ..... 342/375; 342/175

[58] Field of Search ..... 342/375, 203, 175; 333/138, 139

[56] References Cited

U.S. PATENT DOCUMENTS 3,869,693 3/1975 Jones ..... 342/375
4,234,940 11/1980 Iinuma .
4,356,462 10/1982 Bowman ..... 342/375
4,757,318 7/1988 Pulsifer et al. ..... 342/375
4,891,649 1/1990 Labaar et al. .
5,084,708 1/1992 Champeau et al. ..... 342/375
5,144,321 9/1992 Biet ..... 342/375

*Primary Examiner*—Theodore M. Blum
*Attorney, Agent, or Firm*—Ronald L. Taylor

[57] ABSTRACT

A system for introducing true time delays in a phased array antenna for pulsed signals comprising an active, recirculating delay time system which is selectively activated to introduce variable delays in the signal path between the signal transceiver and the individual antenna array elements.

17 Claims, 2 Drawing Sheets

RECIRCULATING DELAY LINE TRUE TIME DELAY PHASED ARRAY ANTENNA SYSTEM FOR PULSED SIGNALS

BACKGROUND OF THE INVENTION

1. Field of the Invention

This invention relates generally to a system and method for introducing true time delays in an RF signal which is applied to radiating elements of a phased array antenna, and more particularly to an active recirculating delay line for introducing true time delays in pulsed RF signals being delivered to the radiating elements of a phased array antenna.

2. Description of Related Art

In the field of radar, systems have been developed that use antennas in which the transmitted power is divided among many radiating elements and in which the phase of each element can be dynamically varied. In such a phased array antenna, the beam can be steered by appropriately varying the phase of the radiating elements. Consequently, antenna beam steering can be accomplished without being constrained by mechanical limitations, such as the rotation of the antenna.

Minimum side lobe level and accurate beam pointing of the phased array antennas require that the actual phase and amplitude distribution of the electromagnetic field generated over the antenna aperture has a minimum ripple, meaning the generated signal approaches the desired smooth, continuous theoretical electromagnetic field distribution as closely as possible. The fact that there are a large, but finite, number of array elements results in a certain minimum amplitude and phase ripple in the electromagnetic field over the antenna aperture. This ripple determines the actual side lobe level and accuracy of the antenna beam pointing.

Any deviation from the minimum desired phase and amplitude distributions reduce the accuracy of beam pointing and increase the side lobe levels of the phased array antenna.

Of those phased array antennas currently in use, most are in fact reduced phase shifter arrays, in which the maximum phase shift that a phase shift element needs to provide is 360°, which is equivalent to a delay length of one wavelength. If delay lines differ in lengths by one or more multiples of the wave length, the continuous wave (CW) signals produced would be indistinguishable. Thus, for CW phased array systems, a maximum delay line length of one wavelength, which introduces a phase shift of 360°, is sufficient. When dealing with RF pulsed signals, however, processing these signals in reduced phase shifter phase array antennas cause the signals to suffer from pulse stretching and deterioration of the rise and fall times of the pulsed signal. More importantly, higher side lobe levels result. High side lobe levels are very undesirable in radar because they permit higher levels of unwanted signals to be picked up by the antenna system. For reasons including high RF losses, high cost and size and weight considerations, a true time delay for a phased array antenna of any practical significance has yet to be constructed. It would therefore be advantageous to provide for a true time delay for a phased array antenna which can delay the signals without degenerating the pulsed signal.

SUMMARY OF THE INVENTION

It is therefore an object of the present invention to provide a system for generating a true time delay for a pulsed RF signal delivered to a phased array antenna. Employing a delay line and a switched feedback delay loop, the system and apparatus of the present invention can generate delays in the output pulsed signal equivalent to any multiple of the delay associated with the delay line. In this system, the delay time of the delay line is equal to or greater than the pulse width of the RF signal. One advantage of the present invention is that a variable differential delay can be created between array elements. Another advantage is the loop gain of the delay feedback loop does not have to be less than one to maintain stability. A further advantage is that only one delay line per element is necessary, significantly less than the multiple delay lines per element required for other true time delay and phase shifter implementations.

BRIEF DESCRIPTION OF THE DRAWINGS

These and other objects, features and advantages of the present invention can be better appreciated by referencing the foregoing description of the presently preferred embodiment in conjunction with the drawings in which.

DETAILED DESCRIPTION OF THE PRESENTLY PREFERRED EMBODIMENT

Figure 1:
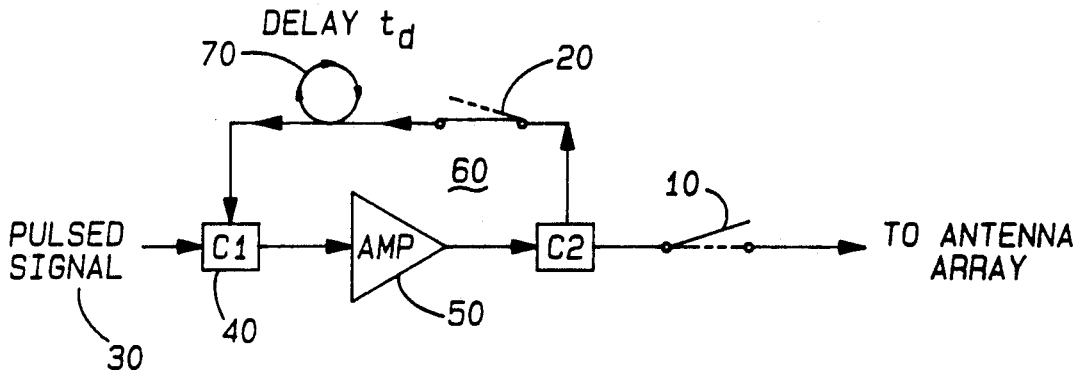
FIG. 1 is a functional diagram of the active recirculating delay line of the present invention.

The fundamental building block of the system and method of the present invention is the active recirculating delay line, as depicted in FIG. 1, in which the delay time ($t_d$) is larger than the pulse width of the incoming signal. Initially, the output routing switch 10 is opened and the delay loop switch 20 is closed. For the purposes of illustration, this functional diagram shows the switches 10, 20 to be of the reflective type, however it can be appreciated that in practice terminated switches would be used to minimize reflection from an open switch. The incoming pulsed signal 30 passes through the first coupler 40, the amplifier 50 and the second coupler 60 prior to reaching the routing switch 10. When the routing switch 10 is open and switch 20 is closed, a signal from coupler 60 is routed into the delay loop 70. It should be noted that, for the first circulation through the delay loop 70, the routing switch 10 is opened and the delay loop switch 20 is closed whenever a pulsed signal is detected at the input of the circuit, which in this embodiment can be considered to be either the first coupler 40, the amplifier 50 or the input terminal of switch 20. Since the delay time introduced by one cycle through the delay loop is $t_d$, circulating the pulsed signal through the delay loop 70 "n" times results in an output pulsed signal which is delayed $n \times t_d$ with respect to the original input pulsed signal, where the output pulse after "n" circulations through the delay loop is an exact copy of the original input pulse. To prevent undesirable noise build up during recirculation of the pulsed signal, the presently preferred embodiment is adapted such that the delay loop switch 20 is closed only when a pulsed signal is actually present at its input terminal;

otherwise, the switch 20 is open. Of course, it can be appreciated that a certain amount of time overlap is necessary to ensure the signal is properly transmitted without accidentally chopping the signal.

Figure 2:
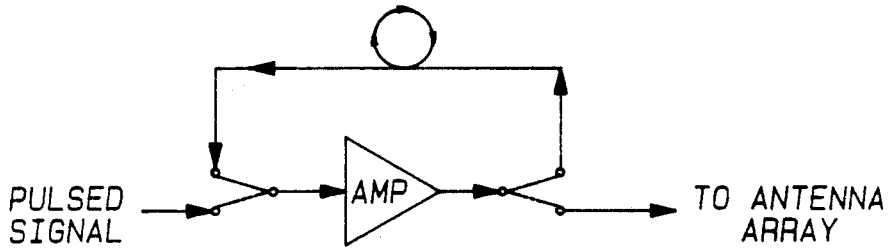
FIG. 2 is an alternative implementation of the active recirculating delay line described in FIG. 1.

As illustrated in FIG. 2, the couplers 40, 60 can be dispensed with. However, in practice, monitor and control during the recirculation process requires tapping into the signal stream in order to synchronize the switching of the routing switch 10 and delay loop switch 20. Thus, couplers are required at some point. In the embodiment depicted in FIG. 1, the couplers 40, 60 can be three dB couplers or power splitters, commercially available from a variety of sources.

Figure 3:
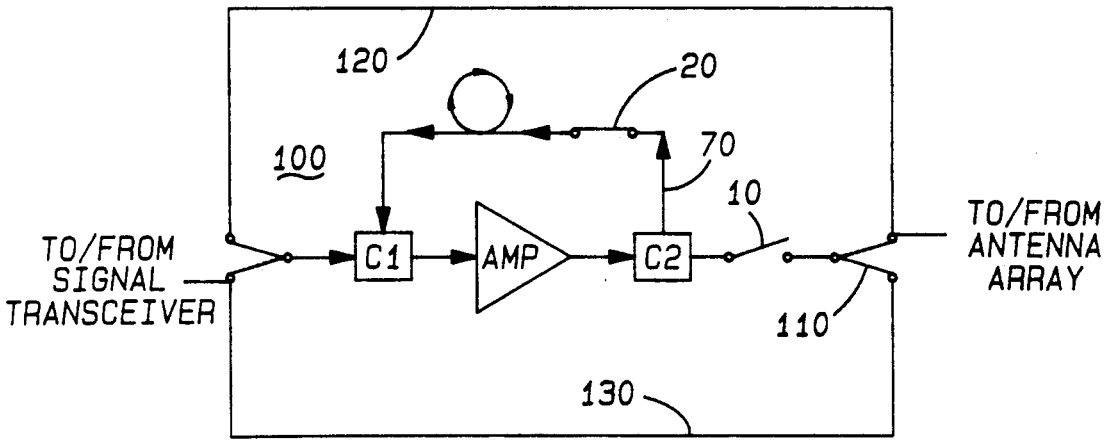
FIG. 3 is a functional diagram illustrating a bidirectional active recirculating delay line.

Expanding upon the basic building block depicted in FIG. 1, a bidirectional recirculating delay line is depicted in FIG. 3. Here, two single-pole single throw switches 100, 110 are employed to form the bidirectional system.

When the switches 100, 110 are in the position shown by the solid lines, the signal received by the antenna array travels along path 120 and is processed through the delay loop 70, eventually routed by the closing of routing switch 10 to travel along path 130 to the signal transceiver. Likewise, when the switches 100, 110 are in the position shown by the dotted lines, the signal generated by the signal transceiver is processed through the delay loop 70 after which it is eventually output to the antenna array.

Figure 4:
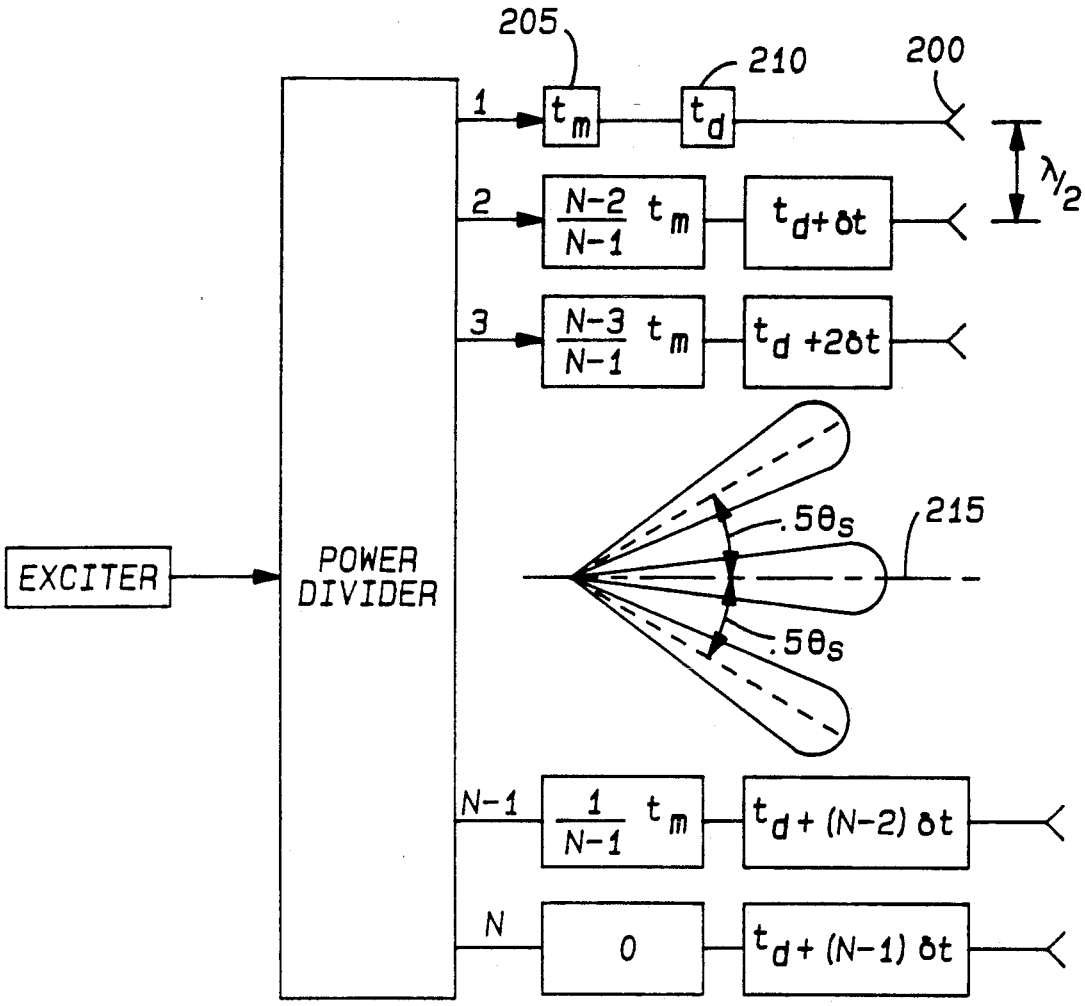
FIG. 4 is a functional diagram of an N element linear phased array antenna.

The ability to introduce variable differential delays in the output of the radar signal can be better appreciated by referring to FIG. 4. Here, an N element linear phased array antenna is depicted functionally. Each array element 200 is spaced one half of a wave length ($\lambda/2$) from its neighboring element. Each array element 200 has a fixed delay 205 and variable delay 210 associated therewith. The fixed delay 205 is implemented in a conventional manner using transmission lines of varying lengths. The variable delay 210 is accomplished using the recirculating delay line as previously discussed. It should be noted that without the fixed delay line 205, the beam could only scan downward from bore sight 215, since delay line systems can only add delay. By combining the fixed delays associated with the fixed delay lines 205 with the variable delays producible by the variable delay recirculation loops 210, scanning in the direction of increasing delay can be accomplished by scanning either up or down from the bore sight 215. Although it is not essential, it is assumed that the scan is symmetric around bore sight 215.

The number of array elements in a phased array antenna generally range from about one thousand to ten thousand. For example, a square array of $70\times70$ would be a midsized array. For purposes of the explanation here, a linear array of seventy elements will be used to highlight the properties of a midsized array.

For any given array antenna, the antenna diameter is proportional to the number of elements and their spacing. Here, there are N elements spaced at $\lambda/2$, yielding an antenna diameter of N $\lambda/2$. The beam width of the phased array antenna on bore sight is used as a system gauge. A fair approximation for beam width is $$BW = \text{Beam Width} = \text{Wave Length} \div \text{Antenna Diameter}$$

$$BW = \lambda \div N\lambda/2 = 2/N$$

Given $N=70, BW=0.029=29$ milli rad

For an X-band phased array antenna having a 90° scan angle ($\theta_s$), where $\lambda=3$ centimeters (10 GHz), the maximum delay time ($t_m$) required can be determined as a function of scan angle and the size of the antenna as follows:

$$t_m = N/c\lambda/2 \sin(\theta_s/2)$$

$$t_m = 70\times3 \text{ centimeters} \div 2c \times \sin 45° = 2.5 \text{ nanosec}$$

This represents a free space wave length of about 75 centimeters, or, given a wavelength of 3 cm, 25 wave lengths.

To implement the present invention for an N element phased array antenna, 2N delay lines are required. The first N delay lines are bias delay lines and the other N delay lines are for the recirculating delay lines. The total number of switches required is 4N, two per recirculating delay line to control the recirculation and two more switch for bidirectionality. In the case of the linear array with N=70, the number of delay lines=140 and the number of switches=280. In contrast, the number of elements to implement such an array using commonly known methods such as a binary tree phase shifter structure called Square Root Cascaded Delay Line is proportional to the number of phased shifter bits, the number of phased array antenna elements and the sin of half the scan angle. Considering most common phased array antennas are three bit phased shifter, the smallest phase shift available is $360°\div8=45°$. So, phased shifters at 0°, 45°, 90° and 180° are required, or three delay lines per 360°, or three phase shifters per wave length delay. In a three bit, seventy element linear phased array antenna, the other elements must be able to be delayed a time equivalent to the propagation and free space over 25 wave lengths, or, in other words $3\times25=75$ delay values that must be created. For a binary tree structure, this means seven delay lines of varying lengths given. The phase shift in the center of the array only needs half the number of delay lines, in this case means four. A fair approximation of the total number of delay lines would then be (# of array elements)×(# of delay lines at center)×(# of bits resolution required for delay values)÷2

75 delay values=7 bits resolution, so $$70\times(4+7)\div2=70\times11\div2=385 \text{ delay lines.}$$

Also, using such a common scheme, the number of switches would be equal to the number of delay lines.

As it can be seen from this example, the reduction in the number of delay lines of the present invention over known systems is a factor of 2.75. Similarly, the reduction in the number of switches is a factor of approximately 1.4. In conventional systems, an increase in resolution from three bits to four bits would increase the number of delay lines and switches by a factor of two. However, in the present invention, the number of delay lines and switches in the system built up according to this invention will not be affected, however, the beam scan factor will be increased by a factor of two. Also, for a three bit resolution system, the number of circulations required to go from a low scan to a high scan is $n=8\times25$ wave lengths=200 circulations. The time this operation takes for a one microsecond pulse given a 10% margin is:

$$\text{scan time} = n \times \text{pulse width} \times \text{margin} = 200 \times 1 \times 1.1 = 0.22 \text{ milliseconds.}$$

For the recirculating delay line true time delay phased array antenna of the present invention, the delay ($\delta t$) associated with the recirculating loop for a three-bit resolution is equal to the time required for the electromagnetic wave to travel over one eighth (i.e. $2^{-3}$) of a wave length, in this case three eighths of a centimeter.

$$\delta t = \lambda/8c = 12.5 \text{ pico seconds.}$$

Such a delay is generated by 2.5 millimeters of fiber optic cable. For practical implementation of these small differential delays, voltage controlled surface acoustic wave (SAW) devices or bulk acoustic wave (BAW) devices can be employed to provide the necessary degree of accuracy.

For most X-band systems, the maximum pulse width would be one microsecond. For the recirculating delay line, this translates into about 200 meters of fiber optic cable. Assuming that the fiber optic cable is wound on a mandrel with a conservative value of the diameter of about one centimeter, a 20 layer coil of 125 micron fiber optic cable yields 50 meters of fiber optic cable per centimeter coiling. So, the required 200 meter fiber optic cable length wound on a mandrel results in a coil approximately ten centimeters long and about 1.5 centimeters in diameter.

Figure 5:
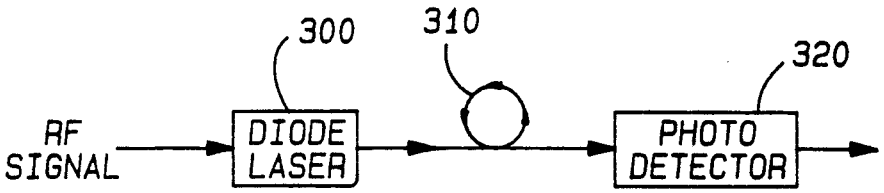
FIG. 5 is a functional diagram illustrating the manner in which the delay is implemented using fiber optics.

Of course, while the pulse is recirculating, there is a noise build up. Each time the pulse circulates through the system, the amplifier and the delay line, noise is added to the pulsed signal. For purposes of this calculation, the delay line is constructed as shown in FIG. 5, with a laser diode 300 modulated with an RF signal level of one mW, a fiber optic line 310 and a diode detector 320. With presently commercially available RF broad band low noise amplifiers operating in the range of eight to ten GHz with a compression point of over twenty mW and noise figures of less than six dB, the noise contribution of this fiber optic system dominates even given the thirty to thirty-four dB loss in the fiber optic delay line system. For a one mW RF input level to the laser diode, the diode contributes less than −140 dBm per Hz noise. The phase noise level of a good quality radar system is about 100 dB per Hz below the signal level. In other words, the signal can circulate ten thousand times before the added amplitude noise equals the phase noise of the signal coming from the system exciter. If bulk acoustic waves are used, which are passive devices, the noise contribution comes from the amplifier only. Such systems add a factor one hundred times less noise per circulation than fiber optic systems. Thus, although the noise increases in each circulation through the recirculating delay line, the magnitude of that increase in noise is not a limiting factor.

The foregoing description of the presently preferred embodiment has been provided for the purposes of illustration. It can be appreciated that one of ordinary skill in the art could exercise any number of modifications to the system disclosed herein without departing from the spirit or scope of the invention disclosed herein.

I claim:

1. A system for transmitting a radar signal from a phased array antenna having a plurality of elements, said system comprising:

exciter means for generating a pulsed signal;

divider means for dividing the pulsed signal for application to each element; and recirculating feedback delay means coupled to each element for variably delaying the transmission of said divided pulsed signal to each of said antenna array elements.

2. A system as recited in claim 1 wherein said recirculating feedback delay means comprises:

an output routing switch; and a delay loop, wherein said divided pulsed signal is routed through said delay loop to create a delayed pulsed signal whenever said output routing switch is open and wherein said delayed pulsed signal is output to said antenna array element and is purged from said delay loop whenever said output routing switch is closed, wherein the delay in said delayed pulsed signal is proportional to the number of times said signal is routed through said delay loop.

3. A system as recited in claim 2 wherein said delay loop comprises:

first and second signal coupling elements;

a delay loop switching element; and an amplifier, wherein said first coupling element has inputs connected to said divided pulsed signal and to said routed signal and has an output connected to said amplifier, and wherein said second coupling element has an input connected to said amplifier and has outputs connected to said output routing switch and said delay loop switching element, wherein said divided pulsed signal is received at said first coupling element, transmitted through said amplifier and transmitted through said second coupling element to said output routing switch, and is transmitted to said delay loop switching element, said delay loop switching element closing only when said delayed pulsed signal is present.

4. A system as recited in claim 3 wherein said amplifier of said delay loop has an amplifier gain of greater than one.

5. A system as recited in claim 1 wherein each said antenna element has a fixed delay associated therewith proportional to the electrical line length between said antenna element and the origin of said pulsed signal.

6. A system as recited in claim 5 wherein said recirculating feedback delay means comprises:

an output routing switch; and a delay loop, wherein said divided pulsed signal is routed through said delay loop to create a delayed pulsed signal whenever said output routing switch is open and wherein said delayed pulsed signal is output to said antenna array element and is purged from said delay loop whenever said output routing switch is closed, wherein the delay in said delayed pulsed signal is proportional to the number of times said signal is routed through said delay loop.

7. A system as recited in claim 6 wherein, for each said antenna element, said divided pulsed signal is delayed a period of time equal to said fixed delay and said variable delay.

8. A system as recited in claim 6 wherein said delay loop comprises:

first and second signal coupling elements;

a delay loop switching element; and an amplifier, wherein said first coupling element has inputs connected to said divided pulsed signal and to said routed signal and has an output connected to said amplifier, and wherein said second coupling element has an input connected to said amplifier and has outputs connected to said output routing switch and said delay loop switching element, wherein said divided pulsed signal is received at said first coupling element, transmitted through said amplifier and transmitted through said second coupling element to said output routing switch, and is transmitted to said delay loop switching element, said delay loop switching element closing only when said delayed pulsed signal is present.

9. A system as recited in claim 5 wherein the total delay associated with any said antenna element is at least as long as said fixed delay associated with that said antenna element and wherein said total delay is varied to be longer than said fixed delay by said recirculating feedback delay means, the varying of said total delay associated with said antenna elements allowing for the varying of the scanning of the beam formed by the transmission of said pulsed signal.

10. A phased array antenna system having a plurality of elements for transmitting and receiving pulsed RF signals, said system comprising:

exciter means for generating a pulsed signal;

divider means for dividing the pulsed signal for application to each element;

selection means for selecting whether said system transmits or receives said pulsed signal; and recirculating feedback delay means, coupled to each element and connected to said selection means, for variably delaying the transmission of said divided pulsed signal to and from each of said antenna array elements.

11. A system as recited in claim 10 wherein said selection means comprises first and second selection elements adapted to form a received signal path through said recirculating feedback delay means when each of said phased array antenna elements is receiving pulsed signals and adapted to form a transmitting signal path through said recirculating feedback delay means when each of said phased array antenna elements is transmitting pulsed signals.

12. A system as recited in claim 11 wherein said recirculating feedback delay means comprises:

an output routing switch; and a delay loop, wherein said divided pulsed signal is routed through said delay loop to create a delayed pulsed signal whenever said output routing switch is open and wherein said delayed pulsed signal is output to said antenna array element and is purged from said delay loop whenever said output routing switch is closed, wherein the delay in said delayed pulsed signal is proportional to the number of time said signal is routed through said delay loop.

13. A system as recited in claim 12 wherein said delay loop comprises:

first and second signal coupling elements;

a delay loop switching element; and an amplifier, wherein said first coupling element has inputs connected to said divided pulsed signal and to said routed signal and has an output connected to said amplifier, and wherein said second coupling element has an input connected to said amplifier and has outputs connected to said output routing switch and said delay loop switching element, wherein said divided pulsed signal is received at said first coupling element, transmitted through said amplifier and transmitted through said second coupling element to said output routing switch, and is transmitted to said delay loop switching element, said delay loop switching element closing only when said delayed pulsed signal is present.

14. A system as recited in claim 10 wherein each said antenna element has a fixed delay associated therewith proportional to the electrical line length between said antenna element and the origin of said pulsed signal.

15. A system as recited in claim 14 wherein, for each said antenna element, said divided pulsed signal is delayed a period of time equal to said fixed delay and said variable delay.

16. A system as recited in claim 11 wherein each said antenna element has a fixed delay associated therewith proportional to the electrical line length between the antenna element and the origin of said pulsed signal.

17. A system as recited in claim 14 wherein, for each said antenna element, said divided pulsed signal is delayed a period of time equal to said fixed delay and said variable delay.

* * * * *